US007313974B2

(12) United States Patent
Cupif et al.

(10) Patent No.: US 7,313,974 B2
(45) Date of Patent: Jan. 1, 2008

(54) SUPPORT FOR ELECTRICAL/ELECTRONIC STRUCTURE AND/OR ELECTRICAL POWER SUPPLY STRUCTURE FOR A HAND DYNAMOMETER TOOL, IN PARTICULAR FOR A TORQUE WRENCH OPERATING BY BREAKING MECHANICAL EQUILIBRIUM

(75) Inventors: Bertrand Cupif, Antony (FR); Philippe Praudel, Longjumeau (FR); Jocelyn Vecchio, Vitry sur Seine (FR)

(73) Assignee: Facom, Morangis (FR)

( * ) Notice: Subject to any disclaimer, the term of this patent is extended or adjusted under 35 U.S.C. 154(b) by 8 days.

(21) Appl. No.: 11/100,528

(22) Filed: Apr. 7, 2005

(65) Prior Publication Data

US 2006/0048584 A1 Mar. 9, 2006

(30) Foreign Application Priority Data

Apr. 9, 2004 (FR) ..... 04 03725

(51) Int. Cl.
*B25B 23/14* (2006.01)
*B25B 23/147* (2006.01)
*B25B 23/159* (2006.01)

(52) U.S. Cl. ..... 73/862.21; 73/862.23; 73/862.191; 81/449; 81/479

(58) Field of Classification Search ..... 73/862.23, 73/862.21, 862.08, 862.191; 81/479, 436–457, 81/467, 477, 480; 429/100
See application file for complete search history.

(56) References Cited

U.S. PATENT DOCUMENTS 3,537,907 A * 11/1970 Wilson ..... 429/120
4,562,746 A 1/1986 Petit
4,805,404 A * 2/1989 Dupin ..... 60/409
6,119,562 A 9/2000 Jenkins
6,234,051 B1 * 5/2001 Bareggi ..... 81/479
6,276,243 B1 * 8/2001 Jenkins ..... 81/479
6,405,598 B1 * 6/2002 Bareggi ..... 73/761
2003/0006049 A1 * 1/2003 Ginell ..... 173/1
2003/0094081 A1 * 5/2003 Becker et al. ..... 81/479
2004/0003683 A1 1/2004 Rudduck
2004/0074652 A1 * 4/2004 Ginell ..... 173/2
2005/0072278 A1 * 4/2005 Cutler et al. ..... 81/467

FOREIGN PATENT DOCUMENTS

DE 2208878 * 9/1973
DE 4103601 C1 * 4/1992
DE 10226134 A1 12/2003
EP 1038638 A1 9/2000

(Continued)

*Primary Examiner*—Michael Cygan
*Assistant Examiner*—Punam Patel
(74) *Attorney, Agent, or Firm*—Wenderoth, Lind & Ponack, L.L.P.

(57) ABSTRACT

A support is for supporting electrical and/or electronic structure and/or electrical power supply structure for a hand dynamometer tool, in particular for a torque wrench operating by breaking mechanical equilibrium. A body of a substantially cylindrical shape that extends along a longitudinal axis, defined by two end faces, recesses and/or seats suitable for receiving electrical power supply members and/or electrical/electronic circuit boards are arranged and distributed around the axis, on or close to a periphery of the support. The support can be applied to a support module for a hand dynamometer tool and to a dynamometer tool.

24 Claims, 6 Drawing Sheets

FOREIGN PATENT DOCUMENTS

| | | | |
|---|---|---|---|
| EP | 1273395 | A2 | 1/2003 |
| EP | 1375072 | A2 * | 1/2004 |
| FR | 2841492 | A1 * | 1/2004 |
| FR | 2842450 | A1 * | 1/2004 |
| WO | 96/11089 | | 4/1996 |
| WO | 03/041914 | | 5/2003 |

* cited by examiner

SUPPORT FOR ELECTRICAL/ELECTRONIC STRUCTURE AND/OR ELECTRICAL POWER SUPPLY STRUCTURE FOR A HAND DYNAMOMETER TOOL, IN PARTICULAR FOR A TORQUE WRENCH OPERATING BY BREAKING MECHANICAL EQUILIBRIUM

The present invention relates to a support for supporting electrical and/or electronic structure and/or electrical power supply structure for a hand dynamometer tool, in particular for a torque wrench operating by breaking mechanical equilibrium.

BACKGROUND OF THE INVENTION

It is known that electrical/electronic and/or electrical power supply structure for a dynamometer tool comprise electrical/electronic circuits and components that are powered by batteries.

Such structure is generally positioned flat, side-by-side, inside the tool or else projecting from outside of the tool.

Such positioning suffers from a drawback of occupying a very large volume, which is detrimental to overall compactness.

In addition, access to other internal assemblies of the tool requires partial disassembly and complete removal of electrical power supply sources.

In this context, the present invention mitigates drawbacks of the prior art by proposing a support for electrical/electronic structure and/or electrical power supply structure for a dynamometer tool, which support optimizes the volume occupied by the electrical/electronic structure and/or electrical power supply structure for the tool. In addition, a support of the invention makes it possible to reduce significantly the cost of industrially assembling together subassemblies for a dynamometer tool.

OBJECTS AND SUMMARY OF THE INVENTION

To these ends, according to the invention, a support for supporting electrical and/or electronic structure and/or electrical power supply structure for a hand dynamometer tool, in particular for a torque wrench operating by breaking mechanical equilibrium, is wherein the support comprises a body of a substantially cylindrical shape that extends along a longitudinal axis, and that is defined by two end faces, and wherein recesses and/or seats suitable for receiving electrical power supply members and/or electrical/electronic circuit boards are arranged and distributed around the axis, on or close to a periphery of the support.

According to other characteristics of the invention:

the recesses and/or seats are distributed radially and, in particular, facing outwardly relative to the longitudinal axis of the support;

the recesses and/or seats extend longitudinally along axes or planes parallel to the axis of the support;

the support is provided with at least one, and preferably three, longitudinal recesses suitable for receiving electrical power supply members;

a passageway is a duct extended at least on one end face of the support by a guide sleeve having a circularly tubular segment;

at least at one of its end faces, the support is provided with positioning structure and/or with fastening structure for positioning and/or fastening an electrical/electronic element perpendicularly to the axis of the support; and the support is a one-piece part, in particular made of a plastic material.

The invention also provides a support module including a support as defined above, at least one electrical power supply member of an optionally rechargeable battery type, and at least one electrical/electronic circuit board, with the at least one member and the at least one board being received respectively in the recesses/seats of the support.

The invention also provides a dynamometer tool for manually applying torque, with the tool extending along a longitudinal axis and comprising:

a drive portion situated at a distal end of the tool and serving to co-operate with a tightening drive member for driving a fastener element;

a handle portion situated at a proximal end of the tool;

an intermediate portion;

an equilibrium-breaking mechanism suitable for delivering predetermined torsion torque to the drive portion, and a calibration device for calibrating bias structure co-operating with the equilibrium-breaking mechanism and making it possible to set a set torque, with the calibration device extending along the longitudinal axis of the tool; and electrical/electronic structure and/or electrical power supply structure and/or measurement structure and/or data management structure and/or data transmission structure, wherein the tool further comprises the above-defined support module, which module is disposed entirely inside the tool.

BRIEF DESCRIPTION OF THE DRAWINGS

The invention will be better understood on reading the following description of an embodiment given by way of non-limiting illustration with reference to the accompanying drawings, in which.

DETAILED DESCRIPTION OF THE PREFERRED EMBODIMENTS

Figure 1A:
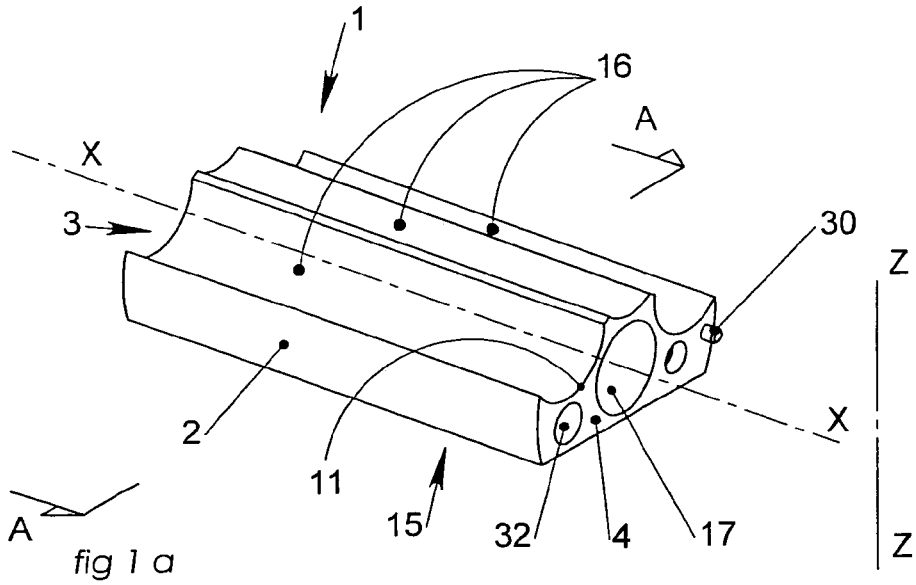
FIG. 1*a* is a perspective view of a first embodiment of a support of the invention for electrical/electronic and/or power supply structure.
Figure 1B:
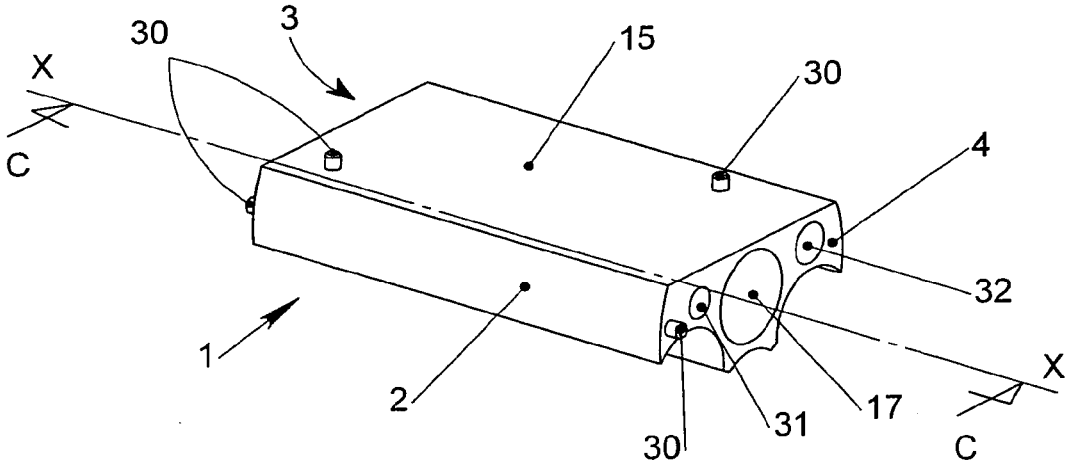
FIG. 1*b* is a perspective view of the embodiment of the support shown in FIG. 1*a* as turned over through 180°.

A support shown in perspective in FIGS. 1*a* and 1*b* is adapted to receive electrical/electronic structure and/or electrical power supply structure for a hand dynamometer tool.

Support 1 has a body 2 that is substantially cylindrical in shape and that extends along an axis X-X. The support 1 is defined axially by a first end face 3 and by a second end face 4, which end faces are substantially perpendicular to the axis X-X.

The body 2 is provided externally with a planar surface 15 parallel to the axis X-X forming a seat suitable for receiving an electronic circuit board, and with three cylindrical recesses 16 extending longitudinally along axes parallel to the axis X-X of the support 1, and suitable for receiving electrical power supply structure such as optionally rechargeable batteries of the "AAA" type.

The recesses and/or seats are distributed about the axis X-X, at a periphery of the body 2, radially and facing outwardly relative to a longitudinal axis of the support 1.

In addition, the body 2 is provided with a central duct 17 of axis X-X that opens out in each of end faces 3 and 4 of the body 2 and that makes it possible to pass a bit constituting a wrench or a screwdriver blade.

Figure 3A:
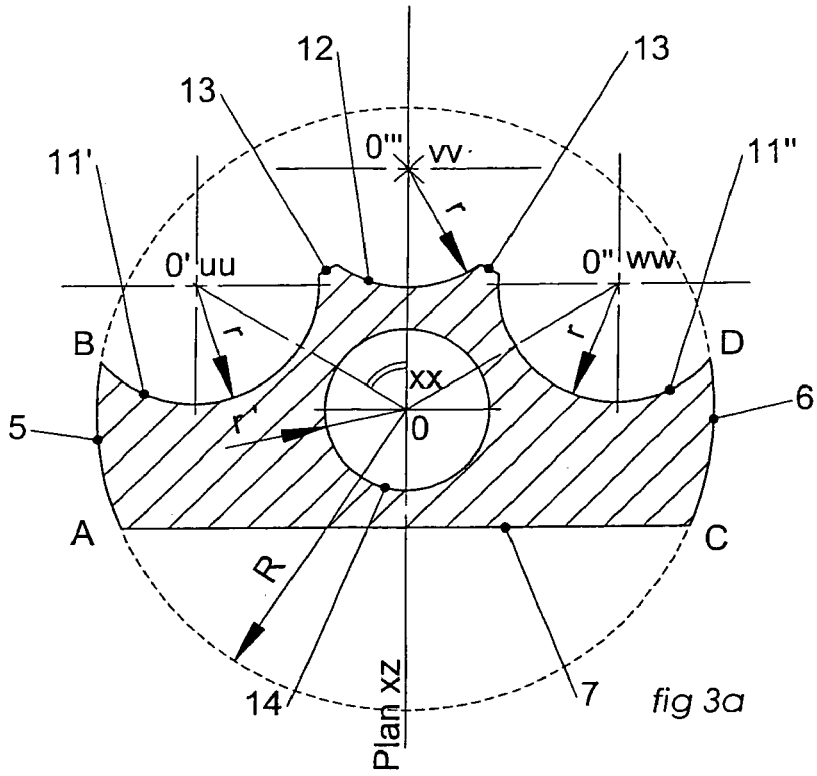
FIG. 3*a* is a view on a larger scale taken in cross-section along line A-A of FIG. 1*a;*

An outside surface of the body 2 has a closed profile as its base, shown in cross-section in FIG. 3*a*, with the base being projected along the axis X-X of the body 2.

An outside profile of the body 2 is symmetrical about a plane XZ, with an axis Z-Z perpendicular to the axis X-X being shown vertically in FIG. 1*a*. This profile includes a first sector 5 and a second sector 6, which sectors are circular and of radius R, and are centered on a point O situated on the axis X-X of the body 2. The first sector 5 is defined by end points A and B, and the second sector 6 is defined by end points C and D. The profile includes a straight line 7 perpendicular to the axis X-X of the body 2 and interconnecting two end points A and C of respective ones of the sectors 5 and 6, which points are situated symmetrically about the plane XZ. Starting from end point B of the sector 5, the profile includes a first sector 11' that is circular, of center O' and of radius r, where r is less than R, and that has its convex side facing towards the center O of the profile of the body 2. Symmetrically, starting from point D of the sector 6, the profile includes a second sector 11" that is circular, of center O" and of the same radius r, and that has its convex side facing towards the center O of the profile of the body 2. A third sector 12, that is circular, of center O'", and of radius r, and that has its convex side facing towards the center O of the profile of the body 2 is positioned such that point O'" is situated in the plane XZ, and that points 0', 0", and O'" are equidistant from point O.

The three sectors 11', 11", and 12 of radius r are distributed angularly on either side of the plane XZ so that these sectors if extended would substantially converge towards the sector 12, if extended, and in particular would converge tangentially.

Two segments 13 of small size connect the sectors 11' and 11" to the sector 12.

As shown in FIG. 3*a*, the base of the body 2 comprises a closed circular inside profile 14 of center O and of radius r', situated inside the outside profile, with the radius r' being dimensioned to maintain a substantial distance between the line 7, the sectors 11', 11", and 12, and the inside profile 14.

As shown in FIGS. 1*a* and 1*b*, the planar face 15 is provided with two positioning studs 30 for positioning an electrical/electronic circuit board.

Similarly, each of the end faces 3 and 4 is provided with a respective positioning stud 30 for positioning an electrical/electronic circuit board.

In addition, the end face 4 is provided with a tapped blind hole 31 suitable for receiving a threaded member (not shown) for fastening an electrical/electronic circuit board to the face 4.

A second duct 32 opens out in each of the end faces 3 and 4 makes it possible to pass a fastener member (not shown) serving to secure the support to another assembly of a tool.

Figure 1C:
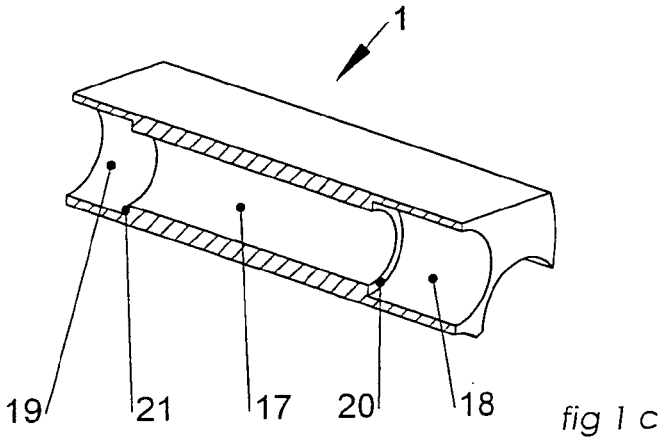
FIG. 1*c* is a perspective view of the embodiment of the support in longitudinal section along line C-C of FIG. 1*b;*

In an embodiment shown in FIG. 1*c*, at each of its ends, the central duct 17 has a bore 18, 19 of radius slightly larger than a radius of the central duct 17.

A shoulder 20 connects the bore 18 to the duct 17, and a shoulder 21 connects the bore 19 to the duct 17.

Inside surfaces of the bores 18 and 19 form guide surfaces for guiding other assemblies of the tool.

Figure 2A:
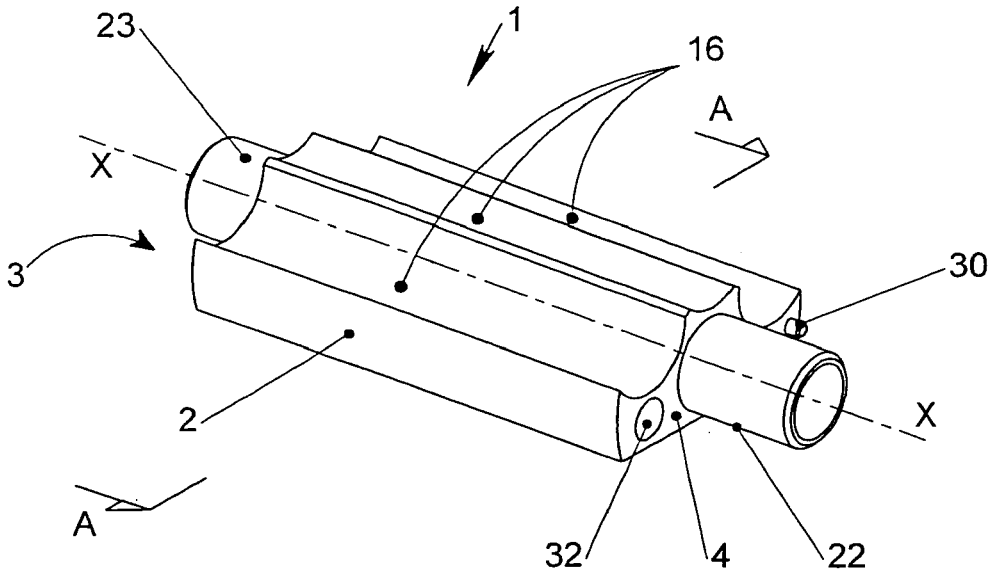
FIG. 2*a* is a perspective view of a variant of the first embodiment of a support of the invention for electrical/electronic and/or power supply structure.

In a variant shown in FIG. 2*a*, the central duct 17 is extended at each of its ends by a respective tubular sleeve 22, 23 formed integrally and of an outside diameter slightly larger than a diameter of the central duct 17.

Outside surfaces of the sleeves 22 and 23 form guide surfaces for guiding other assemblies of the tool.

The support 1 can be made in one piece, e.g. of an injection-molded plastic material.

Figure 3B:
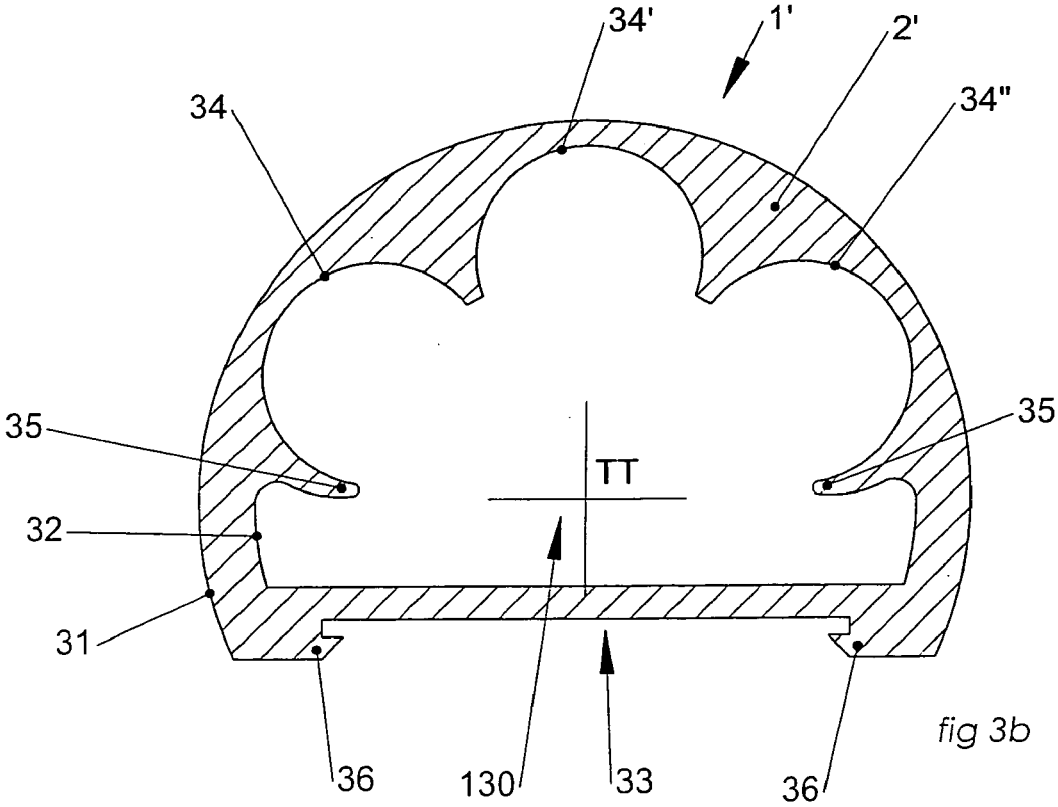
FIG. 3*b* is a view on a larger scale taken in cross-section through a second embodiment of the support.
Figure 4A:
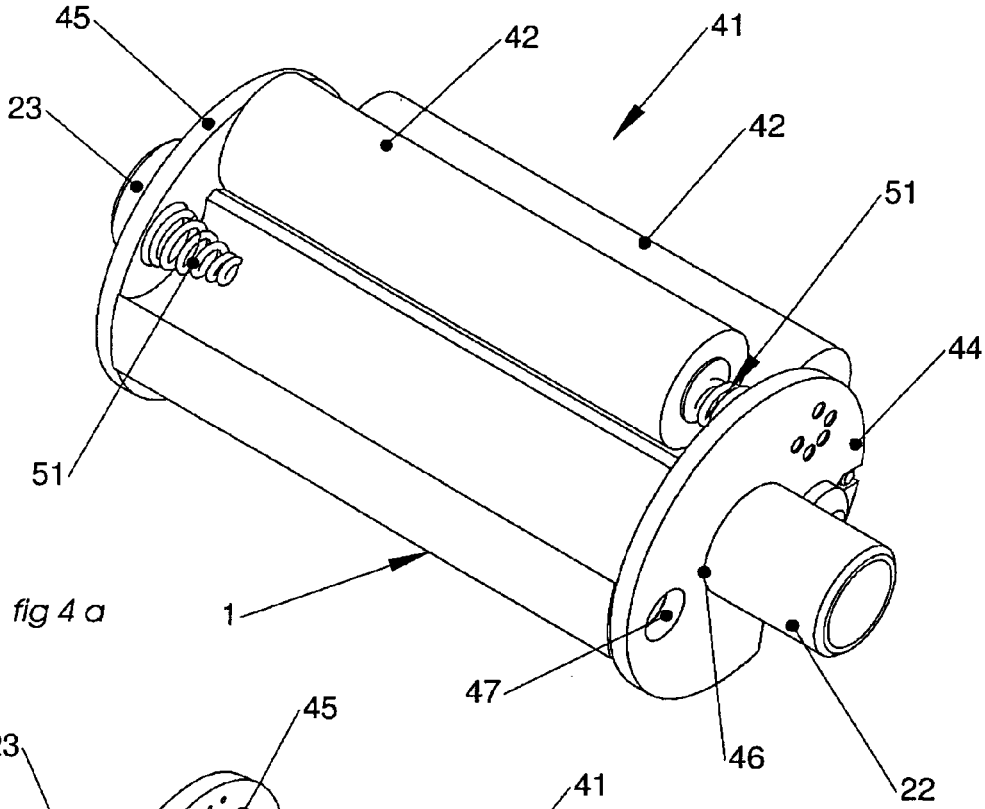
FIG. 4*a* is a perspective view of a support module of the invention, showing the support of FIGS. 2*a* and 2*b;*
Figure 4B:
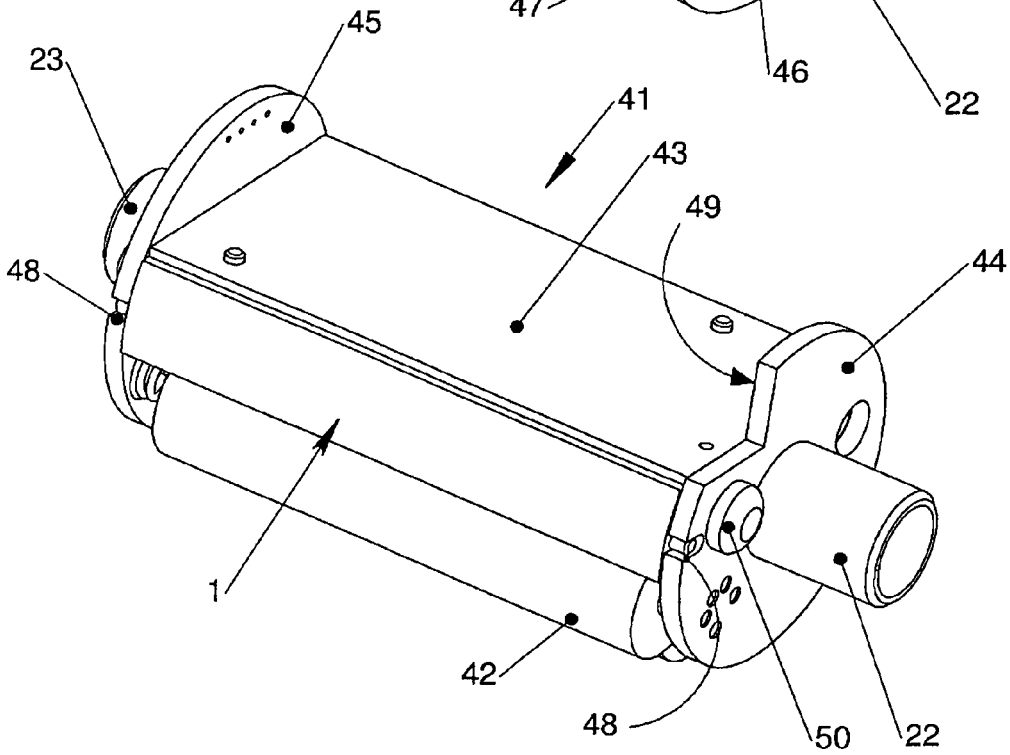
FIG. 4*b* is a perspective view of the support module shown in FIG. 4*a* as turned over through 180°.

In a second embodiment shown in cross-section in FIG. 3*b*, support 1' comprises a body 2' of substantially cylindrical shape extending along a longitudinal axis T-T and having a central hollow zone 130.

An outside profile 31 is provided with a seat 33 for receiving an electrical/electronic circuit, and an inside profile 32 is provided with recesses 34, 34', and 34" for receiving electrical power supply structure.

Deformable elements 35, 36 are suitable respectively for retaining the electrical power supply structure in the recesses 34, 34', and 34", and for retaining an electrical/electronic circuit board in the seat 33.

The recesses and/or seats shown in FIG. 3*b* are also distributed angularly about the longitudinal axis T-T, close to a periphery of the body 2.

The duct 17 shown in FIGS. 1*a* to 1*c* and central hollow zone 130 shown in FIG. 3*b* form a through passageway extending respectively along the axis XX and along the axis TT of the support 1 and 1'.

Figure 2B:
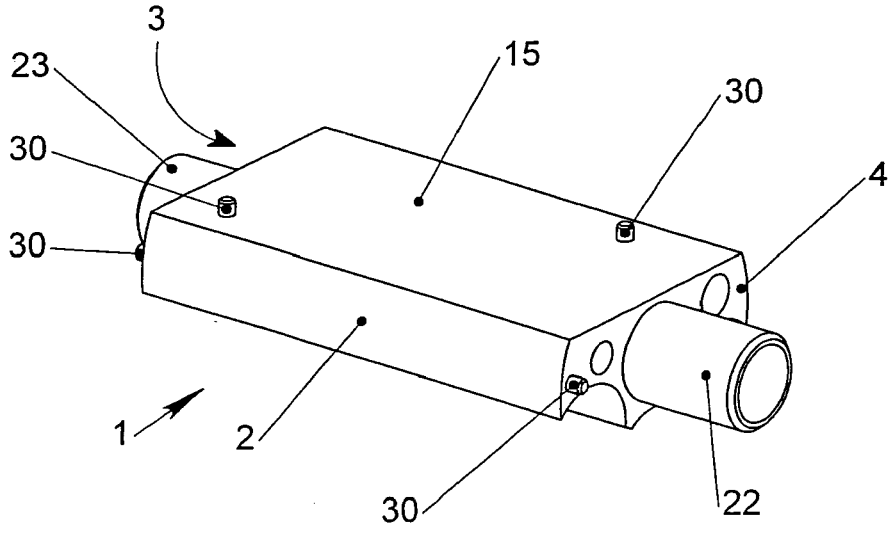
FIG. 2*b* is a perspective view of the variant embodiment of the support shown in FIG. 2*a* as turned over through 180°.

A support module 41 shown in perspective in Figurers 4*a* and 4*b* comprises a support 1 according to FIGS. 2*a* and 2*b*.

The module 41 is equipped with three electrical batteries (only two of which are shown) in the form of optionally rechargeable batteries of the "AAA" type. The module 41 is also equipped with a first electronic circuit board 43 received in a seat formed by the planar face 15 extending in a plane parallel to the axis of the support 1. The module 41 is further equipped on each of the end faces 3 and 4 of the support 1 with a second electrical circuit board 44 and with a third electrical circuit board 45, which boards are positioned perpendicularly to the axis of the support 1.

The second circuit board 44 is provided with a first central orifice 46 of a shape complementary to a shape of the tubular sleeve 22 of the support 1 and facing the sleeve 22.

The second board 44 is also provided with a second orifice 47 that faces the duct 32 in the support 1 and with an oblong notch 48 facing the positioning stud 30 on the end face 4 of the body 2 of the support 1.

The second board 44 is further provided with a third orifice (not shown) facing the tapped hole 31 in the support 1, and with a notch 49 making it possible to leave a passageway for passing electrical/electronic elements, such as a flexible antenna (not shown).

The third circuit board 45 is provided with a first central slot (not shown) of a shape complementary to a shape of the tubular sleeve 23 of the support 1, and facing the sleeve 23.

The third board 45 is also provided with a second slot (not shown) facing the duct 32 in the support 1 and with an oblong notch 48 facing the positioning stud 30 on the end face 3 of the body 2 of the support 1.

A fastening element 50 is screwed into the tapped blind bore 31 in order to hold the second electrical circuit board 44 on the support 1.

Facing positive terminals of two of the power supply members 42, the second circuit board 44 is provided with two electrical contact tabs (not shown). Facing a negative terminal of a power supply member 42, the second circuit board 44 is provided with a deformable electrical contact element 51 resiliently urging the power supply member 42 in question.

Facing a positive terminal of a power supply member 42, the third circuit board 45 is provided with an electrical contact tab (not shown). Facing negative terminals of the other two power supply members 42, the third circuit board 45 is provided with two deformable electrical contact elements 51 (only one of which is shown), which contact elements resiliently urge respective ones of the power supply members 42.

This assembly made up of the two electrical circuit boards 44, 45 and of the three power supply members 42 forms an electrical power supply circuit for the first electronic circuit board 43.

A connection (not shown) electrically connects the electrical power supply circuit to the first electronic circuit board 43.

The first electronic circuit board 43 is further provided with a data transmission unit comprising radio structure and at least one antenna (not shown).

Figure 5:
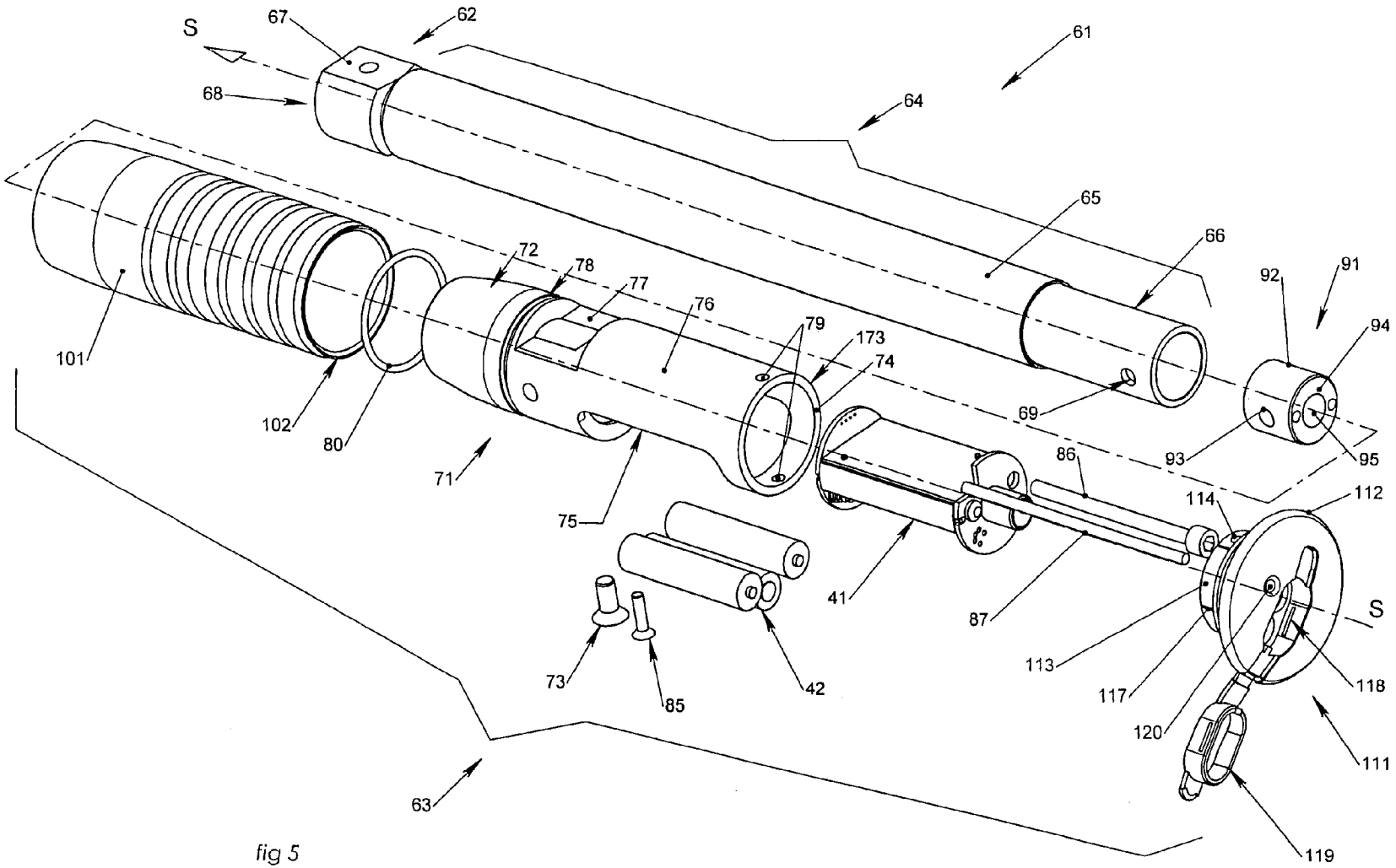
FIG. 5 is an exploded perspective view of a hand tool of the invention.
Figure 6:
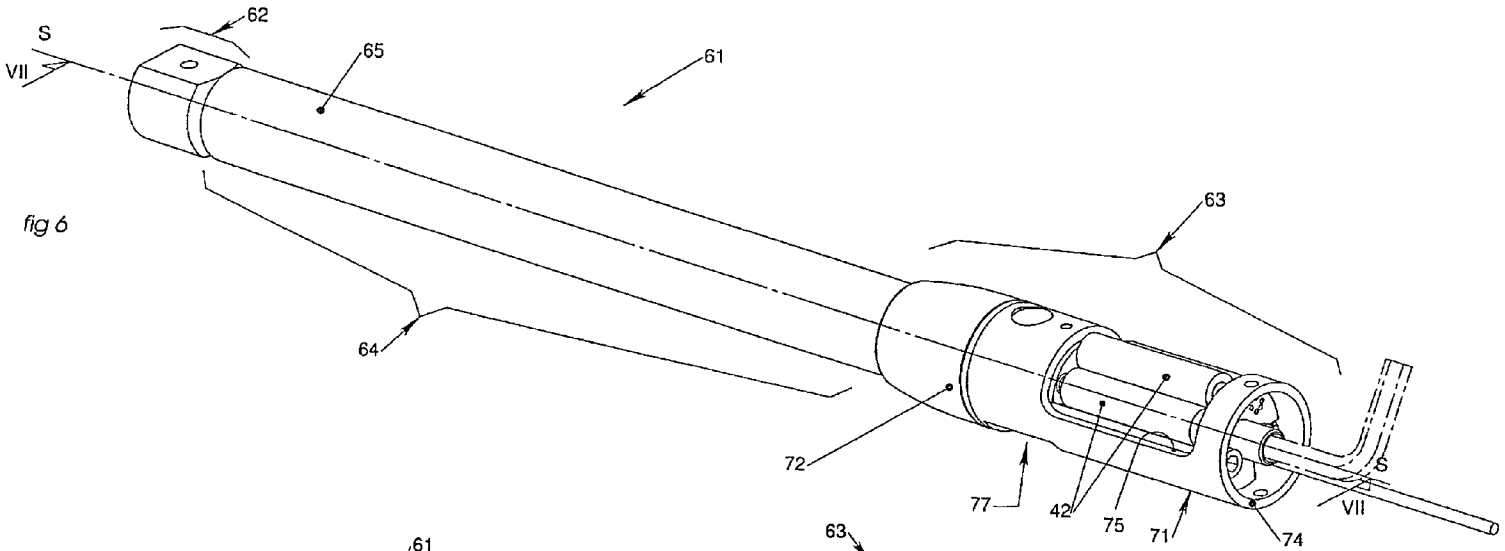
FIG. 6 is a perspective view in a semi-assembled mode of the tool shown in FIG. 5.
Figure 7:
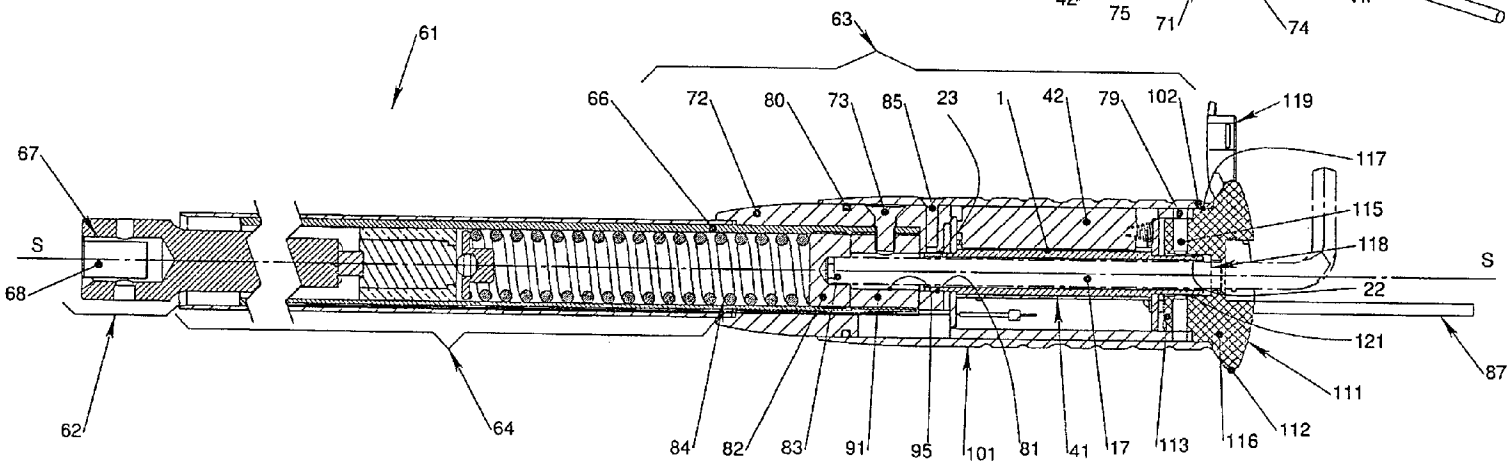
FIG. 7 is a view in longitudinal section of the hand tool along line VII-VII of FIG. 6.

A hand tool 61 shown in FIGS. 5 to 7 is a dynamometer tool, in particular a torque wrench.

The torque wrench 61 extends along a longitudinal axis S-S extending from back to front relative to an operator of the wrench.

The wrench 61 essentially comprises a drive portion 62 situated at a distal or front end of the wrench 61, a handle portion 63 situated at a proximal or back end of the wrench 61, and an intermediate portion 64 in the form of an outer sheath or housing 65 covering an inner tube or bar 66 situated between the drive portion 62 and the handle portion 63.

The drive portion 62 is provided with a front block 67 projecting from a front of the sheath 65 and, at its front end, having an attachment 68 known per se, in which an actuator device (not shown) can be fitted and fastened. The actuator device is typically a reversible ratchet head onto which a tightening socket fits.

A back block (not shown) of the drive portion 62 can extend inside the intermediate portion 64.

Internal mechanical structure connects the drive portion to the intermediate portion and to the handle portion. The mechanical structure makes it possible for an operator to transmit tightening torque to a fastener element by manually applying a force at the handle portion.

The internal mechanical structure can be constituted in particular:

either by a flexion beam provided with measurement structure as described in Patent FR 2 707 395 or FR2 538 741 to the Applicant, with the corresponding wrench being referred to as an "electronic torque wrench";

or by an equilibrium-breaking mechanism biased by a compression spring and equipped with a calibration device, with the mechanism being as described in Patent FR 2 841 492 to the Applicant, and with the corresponding wrench being referred to as a "torque setting wrench" or a "disengagement torque wrench";

or else by an equilibrium-breaking mechanism biased by a compression spring and equipped with a calibration device, with the mechanism being as described in Patent DE 22 08 878, and with the corresponding wrench being referred to as a "break back torque wrench".

A handle portion 63 includes a handle support 71 that is cylindrical in overall shape and that extends coaxially with the axis S-S of the wrench.

The distal end 72 of the handle support is received by being fitted over the tube 66 of the intermediate portion 64. A fastener element 73 secures the handle support 71 to the tube 66 of the intermediate portion 64. In the example shown in FIG. 5, an assembly element 91 that is cylindrical in overall shape and that extends coaxially with the longitudinal axis S-S of the wrench, is provided at its periphery with an external thread 92 suitable for co-operating with a thread provided on an inside wall of the tube 66.

On its periphery, the assembly element 91 is provided with a tapped bore 93 having an axis perpendicular to the axis S-S of the wrench. The fastener element 73 screws into the tapped bore 93 in the assembly element 91 through an orifice 69 provided in a wall of the tube 66.

In addition, a proximal end face 94 of the assembly element 91 is provided with a central bore 95 opening out in a distal face of the assembly element 91 and whose function is described below.

A proximal end 173 of the handle support 71 has a tubular segment 74 extending longitudinally and of shape and of size adapted to receive the support module 41 defined above.

An elongate slot 75 is provided axially and at some distance from a proximal end face over one half of a circumference of an outside wall 76 of the handle support 71.

On mounting the support module 41 in the handle support 71, the recesses 16 suitable for receiving the electrical power supply members 42 are positioned facing the elongate slot 75 in the handle support 71. This configuration makes it possible for the optionally rechargeable batteries 42 to be accessed rapidly.

After the support module 41 has been mounted in the handle support 71, a longitudinal fastening element 86 holds the support module 41 in position in the handle support 71 by passing through the duct 32 in the support 1 and through the orifices provided facing the duct 32 and in the above-defined second and third circuit boards 44 and 45 of the support module 41.

A setback 77 is provided between the slot 75 and the distal end, in that half-circumference which is opposite from the half-circumference in which the slot 75 is provided.

This configuration makes it possible to pass electrical conductors and to connect them to one of the electrical circuit boards 44, 45 positioned perpendicularly to the axis of the support 1 of the support module 41.

In the vicinity of the proximal end of the handle support 71, two holes 79 perpendicular to the axis S-S of the wrench pass through the wall of the tubular segment 74 of the handle support 71.

In addition, between the setback 77 and the distal end 72, the handle support 71 is provided with a groove 78 suitable for receiving a sealing gasket 80, such as an O-ring gasket.

The handle portion 63 also has a handle in the form of a sleeve 101, of a shape and size suitable for fitting over the handle support 71, and fastened securely thereto by use of a radial fastener element 85. Proximal end 102 of the sleeve 101 projects slightly relative to the proximal end 74 of the handle support 71.

The handle portion 63 further includes a proximal stopper 111.

A proximal end of the stopper 111 has a circular radial flange 112 projecting radially relative to the sleeve 101.

A distal end of the stopper 111 is provided with a male portion 113 suitable for fitting into the tubular proximal end 74 of the handle support 71.

The stopper 111 also has an intermediate portion 116 whose male portion is suitable for fitting into proximal female end 102 of the sleeve 101. A sealing bead 117 is formed on an outside surface of the male portion 116 and it co-operates with an inside surface of the sleeve 101.

The stopper 111 is further provided with a passageway 118 extending along the axis S-S of the wrench 61, and in alignment with the duct 17 in the support 1 of the support module 41. A lid 119 makes it possible to close off the passageway 118 through the stopper 111. The stopper 111 is also provided with a passageway 120 suitable for passing a flexible antenna 87 connected to one of the electrical/electronic circuit boards of the support module 41.

On mounting the stopper 111 on the handle support 71, two radial bores 114 provided in distal portion 113 of the stopper 111 are positioned facing the holes 79 in the handle support 71 in order to enable pins 115 to be inserted and thus to secure the stopper 111 to the handle support 71.

As shown in FIGS. 5 and 7, the support 1 of the support module 41 is of the type shown in FIGS. 2*a* and 2*b*.

Longitudinal axes of the various parts coincide along the axis S-S of the wrench.

The sleeves 22, 23 of the support 1 position and guide the support module 41 respectively in bearing surface 121 of the stopper 111 and in bearing surface 81 of the handle support 71.

This configuration offers an advantage of allowing access to internal mechanical device 82 (FIG. 7), such as an internal calibration device for calibrating bias structure such as a compression spring 84. As shown in FIG. 7, the internal calibration device 82 for calibrating the bias structure extends along the longitudinal axis of the tool. This arrangement makes it possible for an operator to insert a bit constituting a screwdriver blade or a wrench in order to access the calibration device 82 from the outside, e.g. in order to access a drive portion 83 of the calibration device 82, by passing successively and from the outside through the stopper 11, through the support module 41, and through the assembly element 91, via the duct 17. The access structure to the drive portion 83 of the internal calibration device 82 for calibrating the bias structure comprises the passageway 118 of the stopper 111, the duct 17 of the support 1 and the central bore 95 of the assembly element 91.

It should be noted that the support described offers improved compactness compared with known configurations, and that industrially assembling together subassemblies and assemblies starting from this support is economically very advantageous for a hand dynamometer tool manufacturer.

The above-described invention also applies to a torque screwdriver.

What is claimed is:

1. A dynamometer tool for manually applying torque to a fastener element, the dynamometer tool having a longitudinal axis and comprising:

a drive portion at a distal end of the dynamometer tool;

a handle portion at a proximal end of the dynamometer tool;

an intermediate portion connecting said drive portion to said handle portion, said intermediate portion including a tubular element, said tubular element containing a mechanical calibration device;

a support module totally within the dynamometer tool, said support module including (i) a body substantially cylindrical in shape and extending along the longitudinal axis, said body being delimited by two end faces, having a passageway extending along the longitudinal axis and being open at each of said two end faces for allowing an operator to insert an adjusting tool from the proximal end of the dynamometer tool and through said passageway in order to access said mechanical calibration device, and having at least one recess arranged around the longitudinal axis, and (ii) at least one electrical power supply member in said at least one recess; and an equilibrium-breaking mechanism for delivering a predetermined torsion torque to said drive portion, wherein said mechanical calibration device extends along the longitudinal axis and is for calibrating a biasing structure that cooperates with said equilibrium-breaking mechanism for setting the predetermined torsion torque.

2. The dynamometer tool according to claim 1, wherein said at least one recess faces outwardly relative to the longitudinal axis.

3. The dynamometer tool according to claim 1, wherein said at least one recess extends parallel to the longitudinal axis.

4. The dynamometer tool according to claim 1, wherein said at least one recess comprises three recesses extending along the longitudinal axis, and said at least one electrical power supply member in said at least one recess comprises an electrical power supply member in each of said three recesses.

5. The dynamometer tool according to claim 1, wherein said support module further includes a tubular guide sleeve extending from at least one of said two end faces, said tubular guide sleeve being coaxial with said passageway so as to define with said passageway a duct.

6. The dynamometer tool according to claim 1, wherein at least one of said two end faces has thereon positioning structure for positioning an electronic element perpendicularly to the longitudinal axis and/or fastening structure for fastening an electronic element perpendicularly to the longitudinal axis.

7. The dynamometer tool according to claim 1, wherein said body comprises a one-piece plastic part.

8. The dynamometer tool according to claim 1, wherein said support module further includes an electronic circuit board positioned perpendicularly to the longitudinal axis.

9. The dynamometer tool according to claim 8, wherein said electronic circuit board positioned perpendicularly to the longitudinal axis has a contact tab for establishing contact with a terminal of said at least one electrical power supply member.

10. The dynamometer tool according to claim 1, wherein said support module is within said handle portion.

11. The dynamometer tool according to claim 1, wherein said handle portion comprises a handle support and a separate sleeve mounted on said handle support.

12. The dynamometer tool according to claim 1, further comprising:

access structure for allowing the adjusting tool to be inserted from outside the proximal end of the dynamometer tool and through said passageway in order to access said mechanical calibration device.

13. The dynamometer tool according to claim 12, wherein said access structure comprises a passageway through a stopper at the proximal end of the dynamometer tool, with said passageway through said stopper extending along the longitudinal axis.

14. The dynamometer tool according to claim 1, wherein said support module further includes data transmission structure for transmitting data by radio.

15. The dynamometer tool according to claim 1, wherein the dynamometer tool is a torque wrench or a torque screwdriver.

16. The dynamometer tool according to claim 1, wherein said biasing structure comprises a compression spring, for biasing said equilibrium-breaking mechanism, such that said mechanical calibration device is for calibrating said compression spring, and said mechanical calibration device includes a second drive portion for cooperating with the adjusting tool when the adjusting tool is passed through said passageway.

17. The dynamometer tool according to claim 16, wherein the adjusting tool includes a bit constituting a screwdriver blade or a wrench.

18. A dynamometer tool for manually applying torque to a fastener element, the dynamometer tool having a longitudinal axis and comprising:

a drive portion at a distal end of the dynamometer tool;

a handle portion at a proximal end of the dynamometer tool;

an intermediate portion connecting said drive portion to said handle portion, said intermediate portion including a tubular element, said tubular element containing a mechanical calibration device;

a support module totally within the dynamometer tool, said support module including (i) a body substantially cylindrical in shape and extending along the longitudinal axis, said body being delimited by two end faces, having a passageway extending along the longitudinal axis and being open at each of said two end faces for allowing an operator to insert an adjusting tool from the proximal end of the dynamometer tool and through said passageway in order to access said mechanical calibration device, and having at least one seat arranged around the longitudinal axis, and (ii) at least one electronic circuit board on said at least one seat; and an equilibrium-breaking mechanism for delivering a predetermined torsion torque to said drive portion, wherein said mechanical calibration device extends along the longitudinal axis and is for calibrating a biasing structure that cooperates with said equilibrium-breaking mechanism for setting the predetermined torsion torque.

19. The dynamometer tool according to claim 18, wherein said at least one seat comprises a seat extending parallel to the longitudinal axis, and said at least one electronic circuit board is on said at least one seat.

20. The dynamometer tool according to claim 18, wherein said at least one electronic circuit board includes a data transmission unit for transmitting data via a radio device.

21. A dynamometer tool for manually applying torque to a fastener element, the dynamometer tool having a longitudinal axis and comprising:

a drive portion at a distal end of the dynamometer tool;

a handle portion at a proximal end of the dynamometer tool;

an intermediate portion connecting said drive portion to said handle portion, said intermediate portion including a tubular element, said tubular element containing a mechanical calibration device;

a support module totally within the dynamometer tool, said support module including (i) a body substantially cylindrical in shape and extending along the longitudinal axis, said body being delimited by two end faces, having a passageway extending along the longitudinal axis and being open at each of said two end faces for allowing an operator to insert an adjusting tool from the proximal end of the dynamometer tool and through said passageway in order to access said mechanical calibration device, and having at least one recess and at least one seat arranged around the longitudinal axis, and (ii) at least one electrical power supply member in said at least one recess and at least one electronic circuit board on said at least one seat; and an equilibrium-breaking mechanism for delivering a predetermined torsion torque to said drive portion, wherein said mechanical calibration device extends along the longitudinal axis and is for calibrating a biasing structure that cooperates with said equilibrium-breaking mechanism for setting the predetermined torsion torque.

22. The dynamometer tool according to claim 21, wherein said at least one recess and at least one seat comprises three recesses and one seat, such that said at least one electrical power supply member in said at least one recess and at least one electronic circuit board on said at least one seat comprises an electrical power supply member in each of said three recesses and an electronic circuit board on said one seat extending parallel to the longitudinal axis, and said support module further includes two electronic circuit boards, each of said two electronic circuit boards positioned at a respective one of said two end faces and extending perpendicularly to the longitudinal axis.

23. The dynamometer tool according to claim 22, wherein said two electronic circuit boards are for establishing an electrical power supply circuit for a first electronic circuit.

24. The dynamometer tool according to claim 23, further comprising:

at least one connection for electrically connecting the electrical power supply circuit to said electronic circuit board extending parallel to the longitudinal axis.

* * * * *